United States Patent [19]

Kehl

[11] 4,419,426

[45] Dec. 6, 1983

[54] METHOD FOR THE VISUAL INSPECTION OF THE REPRODUCTION QUALITY OF DRAWING ELEMENTS AND ELEMENTS FOR THE EXECUTION OF THE METHOD

[75] Inventor: Christof Kehl, St. Gallen, Switzerland

[73] Assignee: Dr. -Ing. Rudolf Hell GmbH, Fed. Rep. of Germany

[21] Appl. No.: 355,736

[22] PCT Filed: Jul. 15, 1980

[86] PCT No.: PCT/DE80/00103

§ 371 Date: Mar. 5, 1982

§ 102(e) Date: Mar. 5, 1982

[87] PCT Pub. No.: WO82/00368

PCT Pub. Date: Feb. 4, 1982

[51] Int. Cl.[3] ..... G03C 5/04

[52] U.S. Cl. ..... 430/30; 430/23; 430/24; 356/404; 356/443

[58] Field of Search ..... 430/30, 24, 23; 356/404, 443

[56] References Cited

U.S. PATENT DOCUMENTS

| | | | |
|---|---|---|---|
| 3,305,841 | 2/1967 | Schwartz | 346/110 R |
| 3,688,033 | 8/1972 | Hell et al. | 178/15 |
| 3,998,639 | 12/1976 | Feldman et al. | 430/30 |
| 4,004,923 | 1/1977 | Hensel | 430/30 |
| 4,183,659 | 1/1980 | Brunner | 355/40 |
| 4,288,157 | 9/1981 | Brunner | 355/40 |

*Primary Examiner*—John E. Kittle
*Assistant Examiner*—Jose G. Dees
*Attorney, Agent, or Firm*—Hill, Van Santen, Steadman & Simpson

[57] ABSTRACT

The present invention relates to a method and to elements for the execution of the method for the inspection of the reproduction quality of drawing elements which are exposed by means of a cathode ray tube on light-sensitive photo material. A simple and feasible development of the quality control of exposed photo material or other printing masters produced in this manner is achieved. The inspection ensues in that additional raster points are exposed which behave differently in response to different exposure and development conditions.

6 Claims, 13 Drawing Figures

NEGATIVE RANGE
NORMAL RANGE
POSITIVE RANGE

FIG. 5
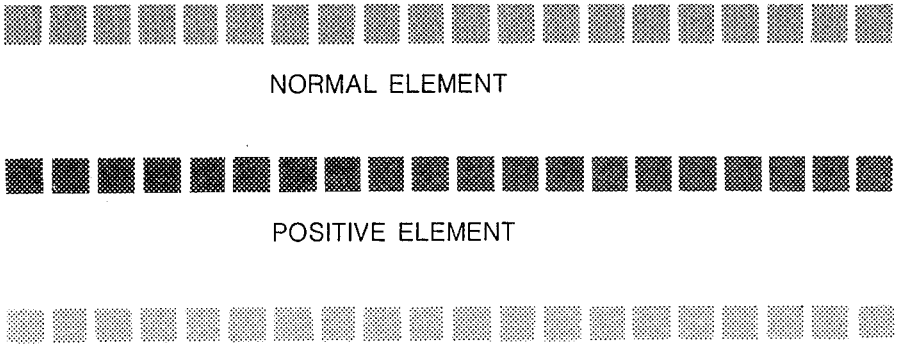
FIG. 6a
FIG. 6b
FIG. 6c
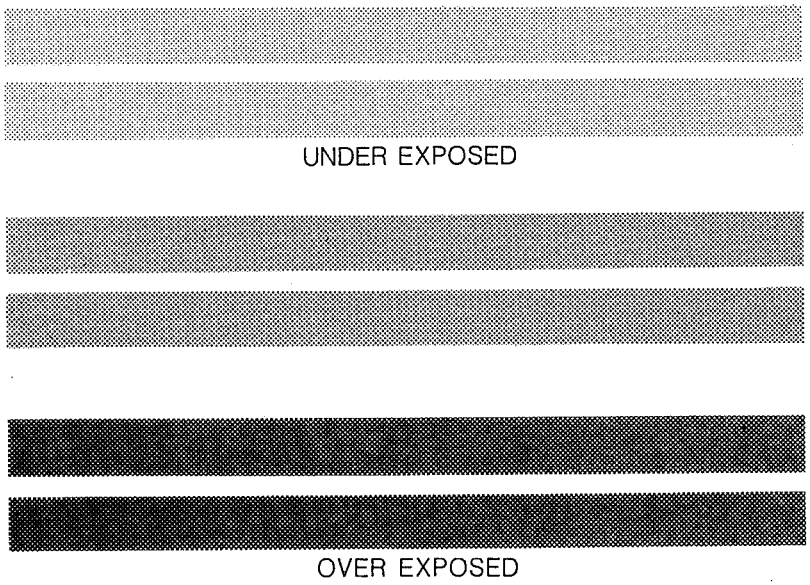

METHOD FOR THE VISUAL INSPECTION OF THE REPRODUCTION QUALITY OF DRAWING ELEMENTS AND ELEMENTS FOR THE EXECUTION OF THE METHOD

BACKGROUND OF THE INVENTION

1. Field of the Invention

Method for the visual inspection of the reproduction quality of drawing elements and elements for the execution of the method.

The invention relates to a method for the visual inspection of the reproduction quality of drawing elements which are exposed by means of a cathode ray tube on light-sensitive photo meterial and also relates to elements for the execution of this method.

2. Technical Field

The invention relates to the field of type-setting technology, particularly to the field of electronic photocomposition for the production of printed products.

3. Description of the Prior Art

The employment of a cathode ray tube for the production of printing masters is presently encountered, for example, in the production of film setting, in plotters and in facsimile teletransmission of printing masters, for example, newspaper pages via telephone lines. Whole-page exposure of news print photo paper or directly on printing plates is, for example, a further use area of the cathode ray tube. The production of type matter in a photographic manner is thereby enjoying greater and greater acceptance and significance in the graphic industry. It may be presently assumed that lead composition will be successively replaced by film setting. In addition to the economical and technological advantages of film setting, however, film setting is burdened with the problem of quality protection.

The following elements are currently used in cathode ray film setting:

Font storage on a magnetic core or semiconductor base for storing image information; light source in the form of a cathode ray tube with an extremely fine resolution density; optical element which images the characters produced on the cathode ray tube onto the photo material and cassettes for the acceptance of film or photo paper. Devices of this type are disclosed, for example, in the U.S. Pat. No. 3,305,841 or in the U.S. Pat. No. 3,688,033.

The blackening or density on film setting paper during composition should be so high that such high contrast arises between the drawing element and the paper white that a photographic exposure on a graphic film is therewith made possible.

One encounters two groups of deficiencies under the quality-determining features of the type reproduction. One group contains errors in the mechanical alignment and positioning of individual letters and entire lines. A second group comprises errors in the optical transmission, i.e., in the exposure and development of the test columns.

Belonging to this group are primarily the blackening or density, the change of line thickness and the type sharpness.

A change of stroke thickness is expressed therein that individual lines or entire groups of text appear thicker or thinner than the surrounding text. This is considered ugly by those active in the graphic field and also by laymen, since the overall impression of printed matter has a restless and untidy effect due to this. Moreover, the legibility of such a text is reduced, since the reader, when he encounters a fatter line, initially believes that he has encountered an intentional emphasis of the text.

Density and change of stroke thickness are two features which largely proceed in parallel, i.e., that a change of density can also be expected given a change of the stroke thickness.

Three methods have been hitherto known for the inspection of the said features:

1. The reading microscope method for the inspection of the change of stroke thickness;
2. The densitometric method for the inspection of the density and of the change of stroke thickness; and
3. The microdensitometric method for the inspection of the density and the change of stroke thickness.

In the reading microscope method, a microscope is employed which is equipped with an ocular screw micrometer. After locating a suitable measuring location, the stroke thickness can be read at the scale division in the ocular. Since the beginning and the end of the stroke to be measured cannot be precisely established on the paper column due to the lack of edge sharpness, this method is subject to a certain uncertainty in fixing the effective stroke thickness.

In the densitometric method, the degree of surface coverage of a raster field exposed on the film setter is measured for the inspection of the change of stroke thickness. When the individual points or lines of the raster field expand, then the degree of surface coverage increases, the field appears optically darker, and a higher measured value can be detected with the densitometer.

In the microdensitometric method, the density over the entire width of the stroke to be measured is continuously sensed with a measuring gap aperture of 0.5 through 5$\mu$ and is recorded in the function of the locus coordinates on a writing means connected for this purpose. The stroke thickness and density can then be measured or, respectively, read from the recorded density profile.

All three described methods have the advantage that precise measured values exist which are not subject to the subjectivity of the human eye. However, expensive measuring instruments which are difficult to manipulate are required for the inspection and the personnel in the graphics trade is not trained for their proper operation. A further disadvantage, particularly in the first and third methods, is the enormous time outlay which is required for the measuring process.

SUMMARY OF THE INVENTION

If one imagines the feature technical and personnel organization in a newspaper composition room in such manner that type columns are no longer exclusively produced by typograhically trained personnel and a plurality of text columns can be exposed and developed in one minute, then there is a need for an inspection method which exhibits the following special characteristics.

No measuring instruments should be required for the inspection and the inspection should be carried out without knowledge of regulations which relate to the inspection system and without special technical training.

The goal sketched above is achieved with the invention described below. Said invention is characterized in that control fields are exposed by means of the film setting machine, said control fields consisting of three different raster points which are combined into a control field. The control field is co-exposed at the beginning and at the end of a text column like the normal text. If conditions arise during the exposure or development process which result in a change of density and stroke thickness, then the terms "overexposed" or "underexposed" can, for example, be perceived or, respectively, read in the control field depending upon whether it is a matter of an increase of the density and stroke thickness values or a matter of a reduction thereof. If no change of density and stroke thickness occurs, then the control field appears as a neutral gray surface which can in turn be very easily identified by the naked eye.

BRIEF DESCRIPTION OF THE DRAWINGS

In the following, the invention is described in greater detail on the basis of FIGS. 1 through 10. There are shown:

FIG. 5 an example for the correct reproduction of the normal, positive and negative elements;

FIGS. 6*a*, 6*b* and 6*c* are examples of underexposure, overexposure and normal exposure for the control field;

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENT

For the purpose of a better understanding of the invention, a few explanations concerning the problems encountered in reproduction in film setting are provided below.

It is known from silver salt photography that a visible silver image can only occur by means of the combination of the two processes, exposure and development, whereby both processes must be matched to one another in intensity and to the photo material and every change of intensity of one of the two processes will produce an altered result. It is particularly different exposure intensities which produce changes of density and stroke thickness in film setting, i.e., the letters appear fatter and darker given increased intensity and become gray and thinner given a lower exposure intensity. There is therefore a processing range for the production of the film setting text columns in which an optimum of type quality is reached. In the following, let this range be called the normal range. Further, there is a range in which a spread of stroke thickness occurs and a range in which a reduction of the stroke thickness occurs. In the following, let these be called the positive range and the negative range.

The present invention now provides three surface elements for monitoring the reproduction quality, so-called raster points, which differ in terms of their reaction to altered processing conditions. One surface element which makes use of the special conditions of the appertaining range was designed for each of the three processing ranges. This behavior can be achieved in that latent intensifications are incorporated in the positive element and latent weak points are incorporated in the negative element. These locations can be termed latent because they have no effect in the normal range.

The recording of the raster points is not illustrated in greater detail below because this is extensively disclosed, for example, in the German LP 15 97 773.

Figures 1, 2, 3:
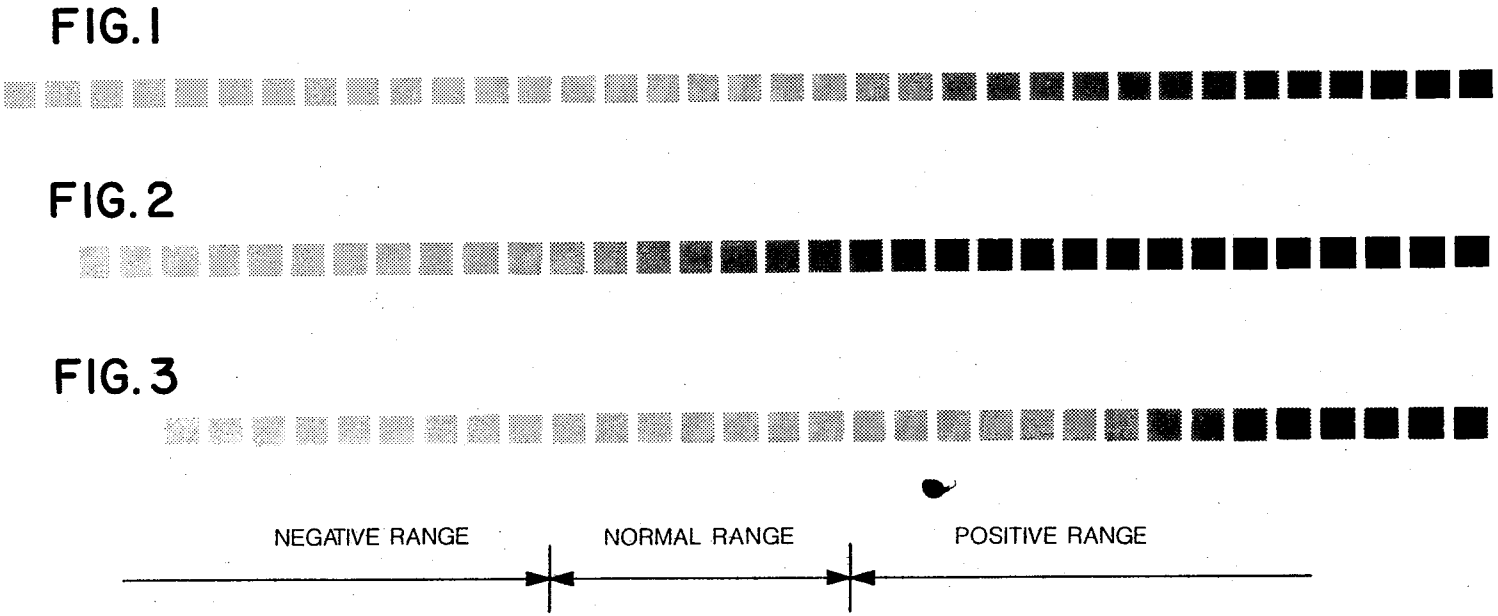
FIG. 1 an example for the reproduction of the normal elements employed in the execution of the method.
FIG. 2 an example for the reproduction of the positive elements employed in the execution of the invention.
FIG. 3 an example for the reproduction of the negative elements employed in the execution of the method.

FIG. 1 shows the behavior of the normal element within the overall processing range. The normal element changes only slightly within the entire range, i.e., negative range, normal range and positive range.

FIG. 2 shows that, in the negative range, the positive element behaves very similar to the normal element, but reveals a clear tendency to enlarge its surface in the positive range.

FIG. 3 shows that, in the positive range, the negative element likewise behaves very similar to the normal element, but shows a clear tendency to reduce its surface in the negative range.

Figure 4:
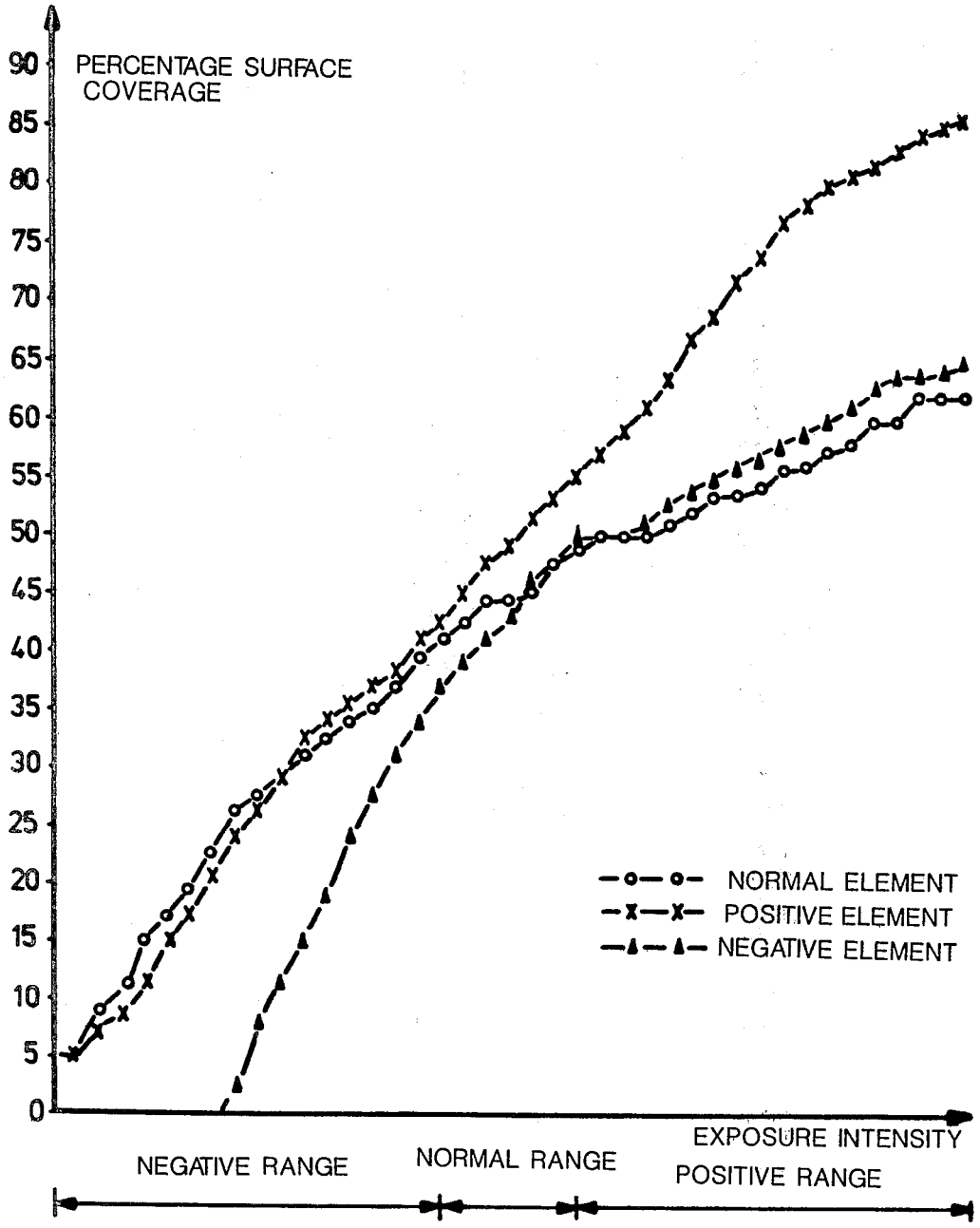
FIG. 4 a diagram for the percentile surface coverage of the elements as a function of the exposure.

FIG. 4 shows the behavior of the tonal value of the three elements relative to one another within a large processing range. The precise format of the individual elements is shown later on the basis of FIGS. 7 through 11.

It can be seen in FIG. 5 that all elements exhibit the same surface in the normal range. They therefore have the same tonal value, for which reason they cannot be visually distinguished from one another.

When either positive elements or negative elements are mixed with normal elements and when the mixing ensues in such manner that elements changing more greatly assume the shape of a specific character, i.e., of a figure, of a letter or of an entire text within the elements changing more weakly (normal elements), then one can therewith check in a very simple manner in which processing range the appertaining text column was produced, or, respectively, whether a change of density and line thickness has occurred.

A control field was realized in FIG. 6 which shows the terms "overexposed" and "underexposed" depending upon whether the text column was exposed with too high or too low an intensity. If, on the other hand, the exposure corresponds to the standard values designated proper by the producer of the film setting, then the control field appears as a neutral gray surface.

Figure 7:
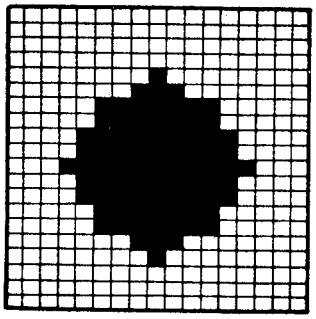
FIG. 7 an example of the format of a normal element.

FIG. 7 shows an embodiment of a normal element which is designed as a raster point with a closed black coverage. It corresponds approximately to a standard raster point as is illustrated in FIG. 5 in the aforementioned German LP No. 15 97 773.

Figure 8:
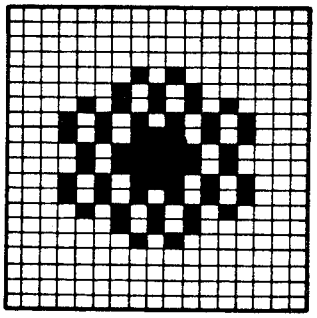
FIG. 8 an example of the format of a negative element.

FIG. 8 shows a sample embodiment of a negative element in which a contiguous black surface is present in the center and the latent weak points are disposed around said central surface, for example, in the manner of a chess board in the form of non-printing, small white surfaces and in the form of small black surfaces.

Figure 10:
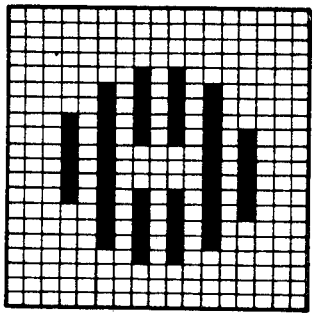
FIG. 10 an example of the format of a negative element.

FIG. 10 shows a variation of such a negative element in which the weak points are distributed over the entire raster point, for example, the element can consist of a central white surface and strips of black and white surfaces adjacent to said white surface.

Figure 9:
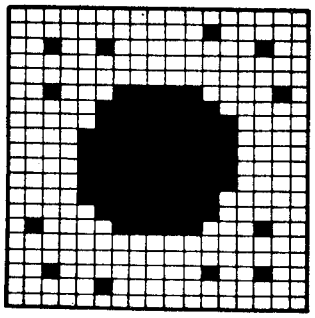
FIG. 9 a further example of the format of a positive element.

FIG. 9 shows an embodiment of a positive element which consists of a central surface of closed black coverage and of individual, small black surfaces which form intensifications and are disposed approximately in the corners of a square surrounding the black coverage. Thereby, the small black surfaces can, for instance, exhibit the size of the smallest printable point.

Figure 11:
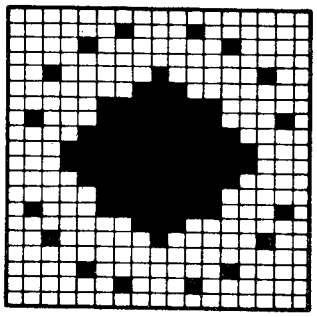
FIG. 11 a further example of the format of a positive element.

An example of a positive element is likewise shown in FIG. 11 which, like the positive element of FIG. 9, exhibits a central, self-contained black surface and latent intensifications disposed in a circle around said surface.

The manner of functioning given overexposure or, respectively, underexposure and normal exposure is briefly explained below.

Normal Exposure

The negative elements according to FIGS. 7 and 10 are exposed in such manner as illustrated in FIGS. 7 and 10, i.e., the percentile proportion of the black surface corresponds to the tonal value to be imaged. The same applies to the normal element and the positive elements according to FIGS. 9 and 11.

In the positive element, the intensifications, i.e., the small points around the central field, are just still reproduced and the respective sums of the black surfaces in all three elements corresponds to the desired tonal value, i.e., the eye views all three elements identically.

Underexposure

The black parts of the negative element are even more weakly reproduced and, in the case of the positive element, the small points surrounding the central area fall away. The reduction of the black surface component in the negative element is significantly greater than in the positive element, for which reason a change of tonal value which is more greatly visually perceptible occurs in the negative element in the case of underexposure.

Overexposure

In the positive element, the latent intensifications, i.e., the small points surrounding the central area, are reproduced intensified, i.e., enlarged. An enlargement of the black elements also occurs in the negative element; this, however, is significantly greater in the case of the positive element, so that a stronger visual perceptibility of the change of tonal value also occurs in the positive element.

The visually perceptible display for overexposure, normal exposure or underexposure becomes possible by means of the combination of negative, normal and positive elements, as is illustrated in FIG. 6. In the case of overexposure or underexposure, the normal element hardly changes, in contrast whereto negative and positive elements respond to different degrees to overexposure or underexposure.

In the following, the formation of the actual control field which is illustrated in FIG. 6 is described in greater detail.

The individual control strip consists of two halves, an upper half and a lower half whereby, in the upper range, the locations which appear over-exposed in FIG. 6*c* below as a plus sign, or as a word, respectively, are formed by positive elements. The locations in which, in the upper strip, FIG. 6A, the minus sign and the word, under-exposed, appear are formed from negative elements. The rest of the control strip consists of normal elements. In FIG. 6*b* work was carried out with normal exposure so that neither the negative elements nor the positive elements appear. The upper strip, FIG. 6A, is under-exposed. This leads to the result that the negative elements become significantly weaker, so that they are recognizable within the normal elements as minus characters and graphic characters. The positive elements are not recognizable since they behave like normal elements given under-exposure. In FIG. 6*c* work was carried out with over-exposure, for which reason the positive elements are strongly over-emphasized and the plus signs and the word appear over-exposed. The negative elements behave like the normal elements and likewise do not appear. This behavior of positive elements, normal elements, negative elements is likewise apparent.

The invention is not restricted to the examples shown in the above Figures but, rather, the individual elements can be varied within the framework of the invention, whereby, however, use is still made of the principle of the present invention.

I claim:

1. A method for the visual inspection of the reproduction quality of drawing elements which are exposed by means of a cathode ray tube on light-sensitive photo material, characterized in that at least three different surface elements which are normal elements, positive elements and negative elements are exposed and such elements differ in their reaction to different processing conditions such that when under-exposed, the negative elements become weaker and when over-exposed the positive elements become stronger and with normal exposure all three elements appear the same, characterized in that said three surface elements are combined with one another such that a control field occurs which has figurative or verbal forms of expression with different processing conditions, characterized in that raster points which have the shape and form of a traditional raster point are employed as said normal elements, characterized in that raster elements which include latent intensification forms are employed as said positive elements, characterized in that raster elements which include latent weak points are employed as said negative elements, and wherein said normal element consists of a contiguous black surface.

2. A method according to claim 1 wherein said positive element consists of a central contiguous black surface and latent intensifications in the form of points indicating the size of the smallest reproducible point are disposed at a distance around the black surface.

3. A method according to claim 3 wherein said positive element has latent intensifications disposed in a circle around the central black surface.

4. A method according to claim 3 wherein said positive element has intensifications disposed approximately in the corners of a rectangle surrounding the central black surface.

5. A method according to claim 1 wherein said negative element comprises a contiguous black surface in the center, and latent weak points are disposed around said central black surface in the manner of a chess board by printing small white surfaces and small black surfaces.

6. A method according to claim 1 wherein said negative element is composed of a central white surface and of strips consisting of black and white surfaces connected to said white surface.

* * * * *